US010739695B2

(12) United States Patent
Ambar et al.

(10) Patent No.: US 10,739,695 B2
(45) Date of Patent: Aug. 11, 2020

(54) GENERATING AN EXPOSED IMAGE

(71) Applicant: HP Indigo B.V., Amstelveen (NL)

(72) Inventors: Oron Ambar, Ness Ziona (IL); Craig Breen, Ness Ziona (IL); Yuval Yunger, Ness Ziona (IL); Haim Vladomirski, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/617,538

(22) PCT Filed: Jun. 23, 2017

(86) PCT No.: PCT/EP2017/065558
§ 371 (c)(1),
(2) Date: Nov. 27, 2019

(87) PCT Pub. No.: WO2018/233845
PCT Pub. Date: Dec. 27, 2018

(65) Prior Publication Data

US 2020/0125000 A1 Apr. 23, 2020

(51) Int. Cl.
*G03G 15/00* (2006.01)
*G03G 15/043* (2006.01)
*G03G 15/04* (2006.01)

(52) U.S. Cl.
CPC ..... *G03G 15/043* (2013.01); *G03G 15/04072* (2013.01)

(58) Field of Classification Search
CPC .. G03G 15/01; G03G 15/043; G03G 15/0472; G03G 15/326; G03G 15/50;
(Continued)

(56) References Cited

U.S. PATENT DOCUMENTS 7,432,945 B2 * 10/2008 Kobayashi ..... G03G 15/326 347/238
7,940,418 B2 * 5/2011 Eom ..... G03G 15/5058 347/246
(Continued)

FOREIGN PATENT DOCUMENTS

JP 2001111833 4/2001
JP 2008078733 4/2008
(Continued)

OTHER PUBLICATIONS

"FAQ: How Do I Fix Banding in My Prints?", MOAB by Legion Paper (Jan. 31, 2010), Retrieved from the Internet on May 31, 2017: https://www.moabpaper.com/blog/2010/1/31/faq-how-do-i-fix-banding-in-my-prints.html.

*Primary Examiner* — Hoan H Tran
(74) *Attorney, Agent, or Firm* — HP Inc. Patent Department

(57) ABSTRACT

Certain examples described herein relate to an optical controller (140) for an exposure unit (115, 215) of a printer. In certain examples, memory (150) stores a plurality of data structures each comprising adjustment factors useable to adjust a plurality of optical elements (216) of the exposure unit. Different data structures correspond to different gray coverages in an image generated by the printer. In certain examples, a processor (160) determines gray levels for different image regions in input image data. In certain cases, the processor links the determined gray levels to corresponding data structures within the plurality of data structures to obtain adjustment factors for the different image regions. In certain cases, the processor adjusts the optical elements for each image region using the corresponding obtained adjustment factors to enable the generation of an exposed image using the exposure unit based on the input image data.

15 Claims, 5 Drawing Sheets

(58) Field of Classification Search
CPC ..... G03G 15/5038; G03G 15/5062; B41J 2/2132; B41J 2/04505
USPC ..... 399/1–4, 31, 32, 38, 51, 72, 118, 177, 399/181; 347/238, 246
See application file for complete search history.

(56) References Cited

U.S. PATENT DOCUMENTS

| | | | | |
|---|---|---|---|---|
| 8,322,811 | B2 | 12/2012 | Chandu et al. | |
| 9,361,558 | B2 * | 6/2016 | Ishida | G03G 15/043 |
| 9,373,067 | B2 * | 6/2016 | Hirano | G06K 15/1228 |
| 9,704,236 | B2 * | 7/2017 | Kogan | G06T 7/0002 |
| 9,817,330 | B2 * | 11/2017 | Tachibana | G03G 15/045 |
| 2008/0124115 | A1 | 5/2008 | Oki | |
| 2013/0278703 | A1 | 10/2013 | Hirano | |

FOREIGN PATENT DOCUMENTS

| | | |
|---|---|---|
| JP | 2013126121 | 6/2013 |
| WO | WO-2015113630 A1 | 8/2015 |

* cited by examiner

GENERATING AN EXPOSED IMAGE

BACKGROUND

Some printing processes write multiple pixels simultaneously. For example, in a digital press using a liquid electrophotographic (LEP) process, laser elements may be used to write pixels onto a photo conductive medium, and multiple laser elements may be used in parallel.

BRIEF DESCRIPTION OF THE DRAWINGS

Examples are further described hereinafter with reference to the accompanying drawings, in which.

DETAILED DESCRIPTION

Figure 1:
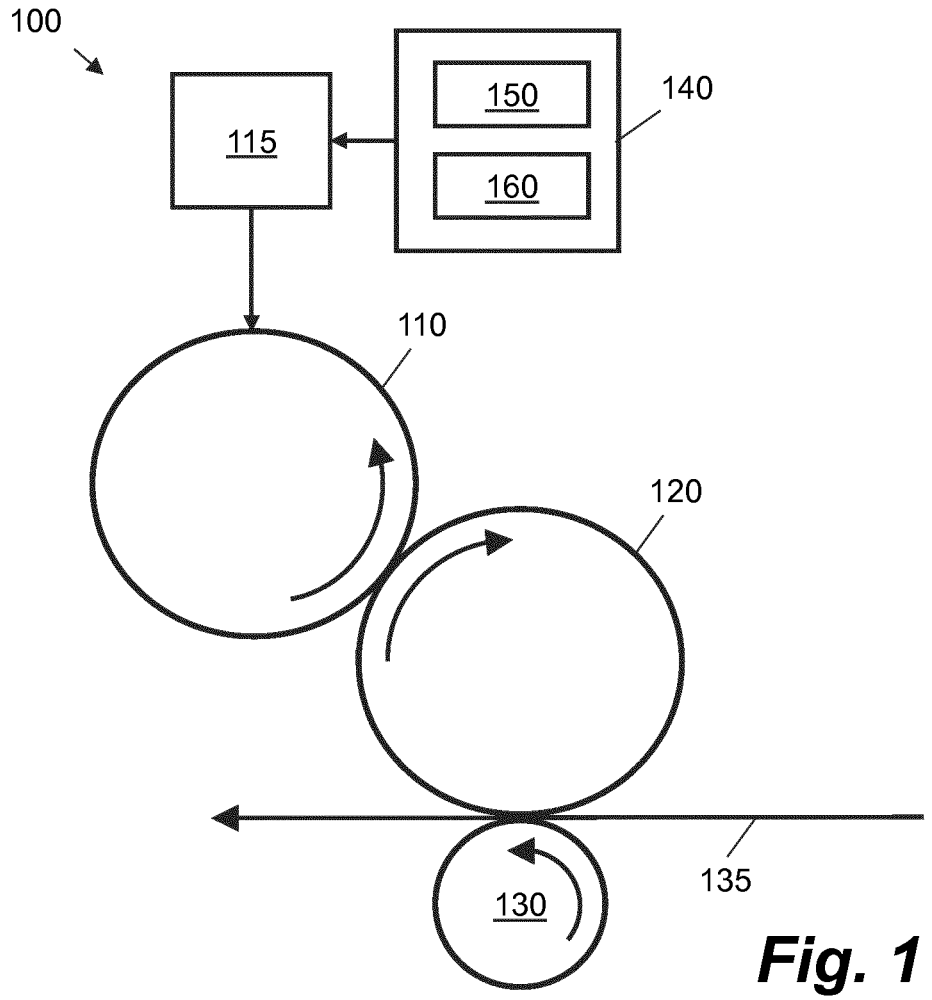
FIG. 1 is a schematic diagram of a printing system according to an example.

FIG. 1 shows a printing system 100 according to an example. Certain examples described herein may be implemented within the context of this printing system. However, it should be noted that implementations may vary from the example system of FIG. 1.

The printing system 100 may comprise a printer, for example a digital press printer. An example of a digital press printer is a digital offset press printer, for example a Liquid Electro-Photographic (LEP) printer. A digital offset printer works by using digitally controlled lasers or LED imaging modules to create a latent image on a charged surface of a photo imaging cylinder. The lasers are controlled according to digital instructions from a digital image file to create an electrostatic image on the charged photo imaging cylinder. Printing fluid such as ink is then applied to the selectively discharged surface of the photo imaging cylinder. Printing fluid is then transferred onto the photo imaging cylinder, creating an inked image. The inked image is then transferred from the photo imaging cylinder to a heated blanket cylinder, where heating evaporates a liquid vehicle from the printing fluid, and finally from the blanket cylinder to a print medium.

In the example of FIG. 1, the printing system 100 comprises a photo imaging plate (PIP) 110. In the present example, the photo imaging plate 110 is mounted onto a cylinder. The cylinder may comprise a holder for attaching the leading edge of the photo imaging plate 110. In some examples, the trailing edge of the photo imaging plate 110 is also attached to the cylinder. In another example, the photo imaging plate 110 is mounted to a belt comprising a closed loop foil. In the present example, the mounted photo imaging plate 110 is rotatable about its axis in an anti-clockwise direction. In other examples, the photo imaging plate 110 is rotatable in a clockwise direction.

The printing system 100 also comprises an exposure unit 115. The exposure unit 115 may comprise an optical exposure unit. The exposure unit 115 is configured to generate an electrostatic image on the photo imaging plate 110. The exposure unit 115 operates in accordance with received image data, otherwise referred to as "print data", "input data", "input image data", "print input data", or the like. The exposure unit 115 may comprise a laser imaging unit. The exposure unit 115 comprises a plurality of optical elements. The optical elements may comprise a plurality of laser elements. Such laser elements may be arranged in an array. An array of laser elements may be embodied as individual laser elements, as multiple channels of a single laser device, as a plurality of laser devices that each have multiple channels, etc. The photo imaging plate 110 may be electrostatically charged prior to being exposed to the optical elements of the exposure unit 115.

The exposure unit 115 dissipates the static charges on selected portions of the surface of the photo imaging plate 110 to leave an electrostatic charge pattern that represents an image to be printed. Printing fluid such as ink is then transferred onto the photo imaging plate 110 by at least one ink unit (not shown). The ink units may comprise binary ink developer (BID) units, wherein each BID unit supplies ink of a different base color. The printing fluid may contain electrically charged pigment particles which are attracted to the image areas of the photo imaging plate 110. The printing fluid is repelled from the non-image areas. An inked image of the print frame is therefore present on the photo imaging plate, i.e. a representation of the image formed from printing fluid.

The printing system 100 also comprises a transfer member 120. In the present example, the transfer member 120 is cylindrical. However, in other examples, the transfer member may be other shapes, e.g. a belt. In the present example, the cylindrical transfer member 120 is rotatable about its axis in a clockwise direction. In other examples, the transfer member 120 is rotatable in an anti-clockwise direction. In an example, the transfer member 120 comprises a blanket wrapped around a surface of the transfer member 120. The transfer member 120 may be otherwise referred to as a blanket cylinder or an intermediate transfer member. The transfer member 120 is arranged to engage with the photo imaging plate 110. The transfer member 120 is configured to receive an inked image from the photo imaging plate 110. In the present example, the inked image is transferred from the photo imaging plate 110 to the transfer member 120 by rotating both the mounted photo imaging plate 110 and the transfer member 120 in opposite directions.

The printing system 100 also comprises a media transport 130. The media transport 130 is configured to move a print medium 135 relative to the transfer member 120 to enable the transfer member 120 to transfer an inked image onto the print medium 135. The media transport 130 is configured to engage with the transfer member 120 to enable the inked image to be transferred from the transfer member 120. The media transport 130 may be otherwise referred to as an impression cylinder or a pressure roller. The image may be transferred from the transfer member 120 to the print medium 135 as the print medium 135 passes to a nip between the transfer member 120 and the pressure roller 130.

The printing system 100 comprises an optical controller 140. In the example of FIG. 1, the optical controller 140 is connectably coupled to the exposure unit 115. In some examples, the optical controller 140 is comprised in the exposure unit 115. The optical controller 140 may be configured to control the exposure unit 115 and/or the various components contained therein, for example by generating and sending control signals.

The optical controller 140 comprises a memory 150. The memory 150 may comprise volatile and/or non-volatile memory. The memory 150 may comprise dynamic or static random access memories (DRAMs or SRAMs), erasable and programmable read-only memories (EPROMs), electrically erasable and programmable read-only memories (EEPROMs) and/or flash memories.

The memory 150 is to store a plurality of data structures. Each data structure comprises adjustment factors useable to adjust a plurality of optical elements, such as lasers, of the exposure unit 115. Different adjustment factors in a given data structure are useable to adjust different ones of the plurality of optical elements. Therefore, each of the plurality of optical elements in the exposure unit 115 may be independently adjustable using a corresponding adjustment factor.

Different data structures stored in the memory 150 correspond to different gray coverages in an image generated by the printing system 100. The data structures may be obtained by performing a calibration operation using a printed calibration image, as described below. In some examples, the gray coverages in the printed image correspond to a set of base gray levels. A set of base gray levels may comprise gray levels that are relatively coarsely spaced. Further gray levels that are not included in the set of base gray levels may be defined between different base gray levels.

In some examples, the adjustment factors of each of the data structures are based on a determined contribution of each of the plurality of optical elements to an optical property of the gray coverages in the printed image. In some examples, a calibration operation is performed using an exposed calibration image, such as an electrostatic image generated on the photo imaging plate 110.

The optical controller 140 also comprises a processor 160. Processor 160 can include a microprocessor, microcontroller, processor module or subsystem, programmable integrated circuit, programmable gate array, or another control or computing device.

The processor 160 is configured to determine gray levels for different image regions in input image data. A gray level for an image region may be determined by obtaining digital halftone values from the input image data and averaging the digital halftone values across the image region. In some examples, a gray level for an image region is determined by obtaining a set of optical power parameters for each pixel in the image region. The set of optical power parameters for each pixel may comprise four optical power parameters, although other numbers of optical power parameters may be used. An optical power parameter may relate to an optical power level. Determining the gray level for an image region may comprise averaging the optical power parameters across the pixels of the image region. In some examples, a gray level for an image region may be received. The gray level may be received from a further entity (not shown). An example of a further entity is an image generation controller. The gray level may be received as part of the input image data. The gray level may be received to enable the processor to obtain adjustment factors for the given image region. In some examples, a gray level for an image region is determined based on color values of pixels of the image region in the input image data. The color values may correspond to cyan, magenta, yellow (CMY) values.

The processor 160 is further configured to obtain adjustment factors for the different image regions. The adjustment factors for the different image regions are obtained by linking the determined gray levels to corresponding data structures within the plurality of data structures stored in the memory 150. In some examples, the processor 160 is configured to use a look-up table to map a determined gray level to a corresponding data structure.

In some examples, if a determined gray level for an image region is different from each of a set of base gray levels, the processor 160 is configured to interpolate adjustment factors between different data structures to obtain the adjustment factors for the image region. In some examples, a look-up table is used to indicate how to interpolate the adjustment factors between different data structures. For example, the determined gray level may be between a first base gray level and a second base gray level, the second base gray level being adjacent the first base gray level in the set of base gray levels. The processor 160 may use the look-up table to link the determined gray level to a first data structure corresponding to the first base gray level and a second data structure corresponding to the second base gray level. A number of interpolation points be used between data structures of consecutive base gray levels. For example, two, three or four interpolation points may be used. In addition to enabling the processor 160 to map a determined gray level to a data structure, the look-up table may indicate which interpolation point between consecutive data structures is to be used to obtain the adjustment factors for the image region.

In some examples, the determining of the gray levels and/or the obtaining of the corresponding adjustment factors for each image region is performed in real-time, for example during a print job.

The processor 160 is further configured to adjust the optical elements for each image region using the corresponding obtained adjustment factors to enable the generation of an exposed image using the exposure unit 115 based on the input image data. The exposed image may be generated by the plurality of optical elements in the exposure unit 115 based on control signals received from the optical controller 140.

In some examples, printing system 100 comprises a measurement unit (not shown) to measure an optical property of a printed image. For example, the measurement unit may comprise an in-line camera, in-line scanner, in-line spectrophotometer, or similar device.

Figure 2:
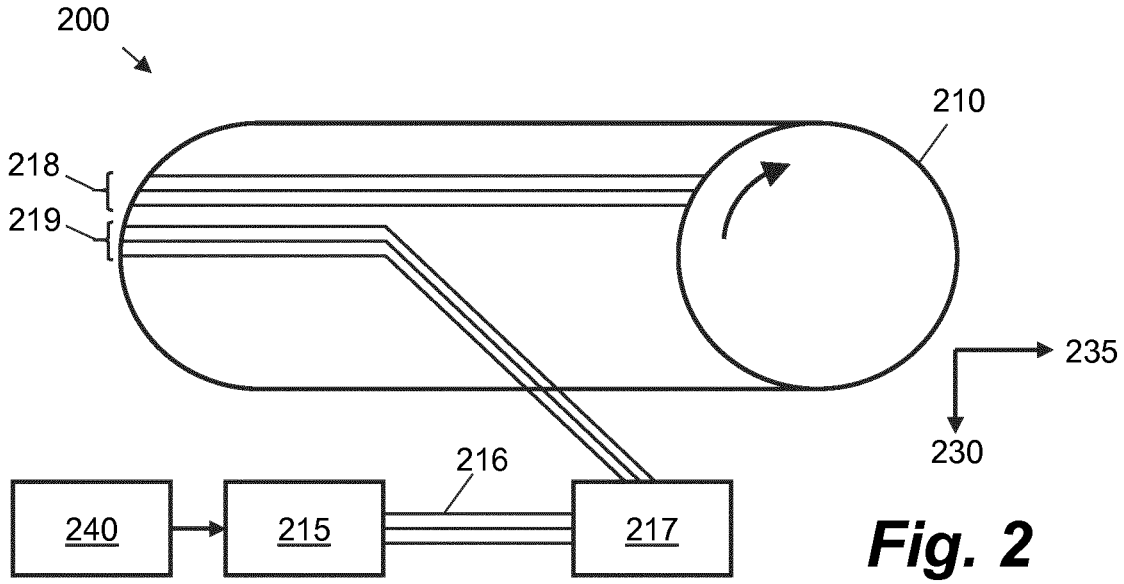
FIG. 2 is a schematic diagram of a printing system according to an example.

FIG. 2 shows a printing system 200 according to an example. Some items depicted in FIG. 2 are similar to items shown in FIG. 1. Corresponding reference signs, incremented by 100, are therefore used for similar items.

Printing system 200 comprises a photo imaging plate 210 mounted on a rotatable cylinder. An exposure unit 215 comprising an array of lasers 216 is controlled by optical controller 240. The optical controller 240 is configured to obtain adjustment factors for the array of lasers 216 as described above.

Printing system 200 also comprises a polygon mirror 217. In some examples, the exposure unit 215 comprises the polygon mirror, for example as one of a plurality of optical elements of the exposure unit 215. In some examples, the polygon mirror 217 is separate from the exposure unit 215. The polygon mirror 217 may be configured to scan the array of lasers 216 across a surface of the photo imaging plate 210 in a scan direction 235, for example via rotation of the polygon mirror 217. The array of lasers 216 and the polygon mirror 217 may be arranged to write successive swathes 218, 219 across the surface of the photo imaging plate 210. FIG. 2 schematically shows a completed swathe 218 and a swathe in the process of being written 219. The mounted photo imaging plate 210 may rotate about its axis in order to allow successive swathes to expose different parts of the surface of the photo imaging plate 210. Rotation of the photo imaging plate 210 may correspond to a media transport direction 230, which may be perpendicular to the scan direction 235. Each swathe may have a number of lines equal to the number of lasers in the array. For simplicity, the array of lasers 216 shown in FIG. 2 comprises 3 lasers, however other numbers of lasers could be used, for example the array may include 12, 18, 28, 36 or 40 lasers.

In some examples, the array of lasers 216 may be scanned across the surface of the photo imaging plate 210 using means other than a polygon mirror, for example by using phased array scanning techniques, refractive optical components, acousto-optical deflectors or electro-optic deflectors.

The power received from a laser of the array 216 at the surface of the photo imaging plate 210 may vary across a swathe, in the scan direction 235, due to differences in the optical path as the lasers are scanned across the photo imaging plate 210, for example. Differences in the optical path may be due to the optical design or production tolerances of the optical elements being used. Further, the power received from a laser at the surface of the photo imaging plate 210 may vary between different swathes, for example due to variations in optical properties between different facets of polygon mirror 217. Variation in received laser power may lead to differences in the optical spot shape on the surface of the photo imaging plate 210 across a swathe and/or between different swathes. This may result in dot area non-uniformity in a printed image. This may, in turn, lead to visible artifacts in the printed image.

In some examples, individual laser elements of an array are controllable independently of image data. For example, a format correction feature may be provided that allows laser power to be varied along the scan direction. In some examples, format correction allows the power of each laser to be independently varied at intervals along the scan direction 235. In some examples, the intervals each correspond to 1 mm along the scan direction 235. In other examples, the intervals each correspond to 10 mm along the scan direction 235. In some examples, the format correction feature may be implemented by controlling a current provided to each laser element in each interval. In other examples, a pulse width of the laser is controlled instead of, or in addition to, the current provided to the laser. In some examples, the laser profile to be applied using format correction is controlled as 1st or $2^{nd}$ order polynomials, with parameters of the polynomials being selected to reduce or minimize measured artifacts according to a trial-and-error approach. In some examples, a two-dimensional array or data structure indicative of the corrections to be applied to the lasers using format correction may be stored, for example to a file, and loaded on demand when format correction is to be applied. One dimension of the array may correspond to a location along a scan direction, and the other dimension of the array may correspond to the laser element in the array of laser elements. In some examples, such correction data comprises a third dimension corresponding to a facet of a polygon mirror. In one specific implementation, a given data structure comprises corrections for 40 lasers and 6 polygon facets at 100 predetermined locations along the scan direction. For a given pixel, a power of a laser element may be adjusted by a first correction factor and a second correction factor. The first correction factor corresponds to the laser element. The second correction factor corresponds to the polygon facet. For a given pixel that does not correspond to one of the predetermined locations along the scan direction, interpolation may be performed between correction factors for the locations that are the nearest neighbors of the given pixel.

Variation in received power between lasers may lead to a lack of uniformity in the final printed image. Optical power density non-uniformity may lead to non-uniformity of the dot area on the print medium. Non-uniformity between laser elements may lead to periodic disturbances in the final image, known as scan band artifacts. Such variation can be caused by differences between the individual laser elements or between different facets of a rotatable polygon mirror, but may also be caused by interference or crosstalk between the lasers during operation. Calibration of the lasers may be performed on individual lasers in an array. However, this may not address variation in laser output due to interference or crosstalk between the lasers, since this occurs when multiple lasers of the array are operated together and does not occur when the lasers are operated separately. Additionally, differences between optical characteristics of the lasers may contribute to dot area variation between lasers in a swathe. Furthermore, in order to achieve a high printed resolution, the number of lasers in an exposure unit may be increased, for example to 40 lasers, and the spacing between adjacent lasers in an array may be reduced. The density of screen coverages may also be increased in order to achieve a higher resolution. Consequently, interactions between different lasers and/or with the screen data can become complex and may lead to the dot area variation between lasers and/or between different polygon facets being dependent on the gray level coverage that is being used. In some examples, the banding profile of the array of lasers is different for different gray levels due to thermal effects and/or electrical cross-talk of the lasers. Dot area variation may be different for different gray levels but may not be directly proportional to the gray level being used, and therefore may not be obtainable via a constant or known factor. Banding artifacts for different gray levels are therefore difficult to predict due to the complexity of the interactions and effects of the simultaneously-used laser elements. In some examples, dot area variation between different polygon mirror facets also behaves differently for relatively sparse or relatively dense screen coverages.

Figure 3:
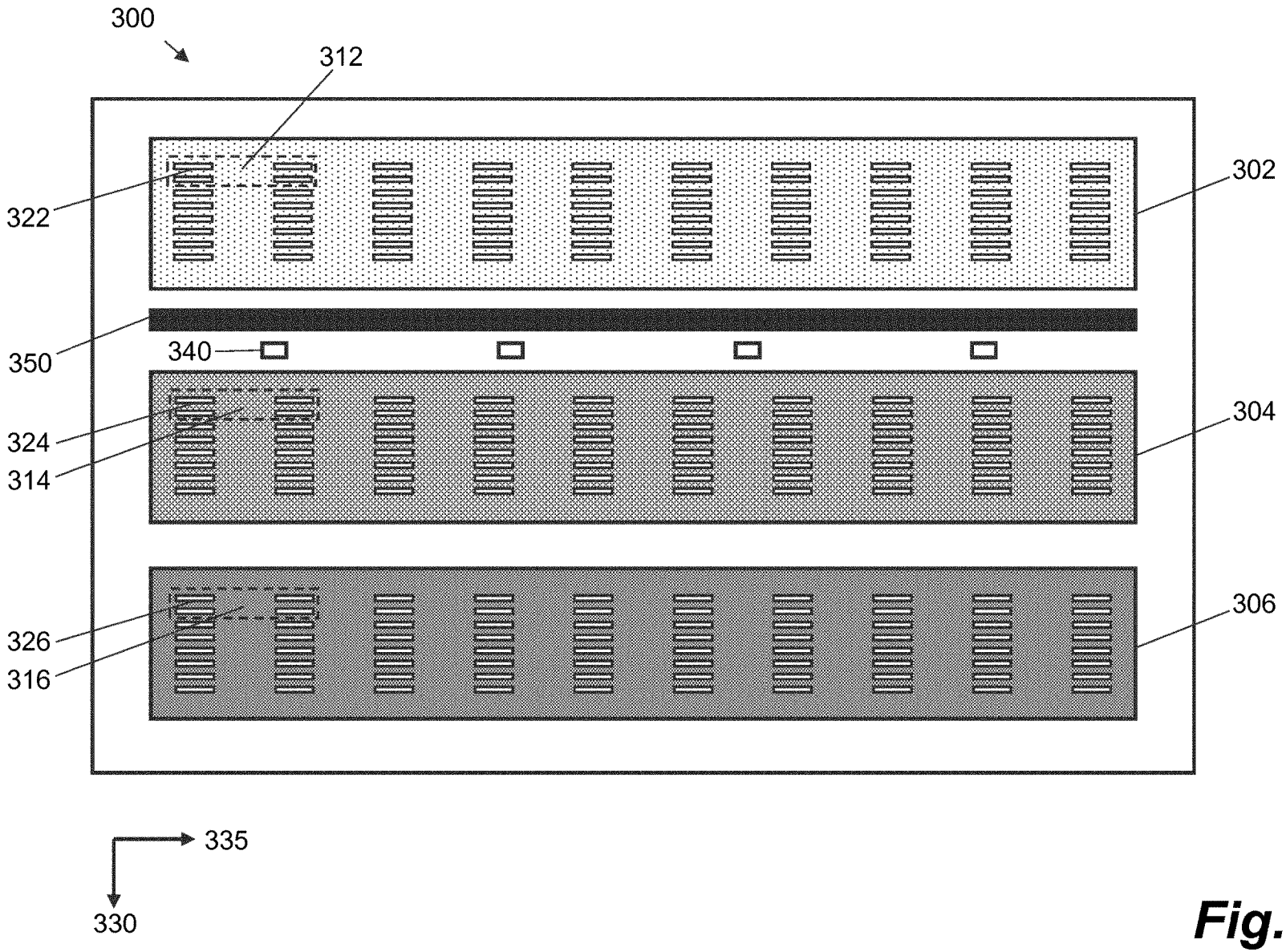
FIG. 3 is a schematic diagram of a printed image according to an example.

FIG. 3 shows a printed calibration image 300 according to an example.

The printed calibration image 300 may be generated by printing system 100. Generating the calibration image 300 may involve controlling a plurality of laser elements of an optical exposure unit, such as exposure unit 115. The calibration image 300 may be generated as part of a calibration operation. The calibration operation may be performed in order to generate sets of corrections or adjustments to be applied to the plurality of laser elements.

The calibration image 300 comprises a plurality of calibration sections 302, 304, 306. For simplicity, the calibration image 300 shown in FIG. 3 comprises 3 calibration sections, however other numbers of calibration sections could be used, for example the calibration image 300 may comprise 5, 6, 7 or 8 calibration sections.

Each of the calibration sections 302, 304, 306 has one of a plurality of different base gray levels. A base gray level for a given calibration section may correspond to a gray coverage applied to the calibration section using the plurality of laser elements. For example, a relatively high laser output power may correspond to a relatively high gray coverage (e.g. a darker gray level), and a relatively low laser output power may correspond to a relatively low gray coverage (e.g. a lighter gray level). A laser element having a relatively high output power may cause a relatively high level of discharging on the charged surface of a photo imaging plate, thereby resulting in a darker gray printed image, and a laser element having a relatively low output power may cause a relatively low level of discharging on the photo imaging plate, thereby resulting in a lighter gray printed image. The output power of the laser elements may be adjusted by adjusting a pulse width and/or frequency of the laser elements.

Each of the calibration sections 302, 304, 306 has a calibration portion 312, 314, 316. In some examples, each of the calibration sections 302, 304, 306 has a plurality of calibration portions. A given calibration portion in a calibration section may be produced by writing a swathe along a scan direction 335 using the plurality of laser elements. A calibration portion may correspond to a single swathe along the scan direction 335. That is, a calibration portion may correspond to a given facet of a polygon mirror used to scan the laser elements across the photo imaging plate. In some examples, a calibration portion is produced by a plurality of consecutive swathes, or by a predetermined portion of a swathe. For simplicity, in the example shown in FIG. 3, a single swathe in the scan direction 335 corresponds to 9 consecutive calibration portions in the scan direction 335, although different numbers of calibration portions may be produced by each swathe in other examples. Each calibration portion may have a length in the scan direction 335 of 8 mm or 10 mm, although other lengths may also be used.

Each of the calibration portions 312, 314, 316 may have corresponding registration marks 322, 324, 326 indicative of a start and an end of the calibration portion in a direction that is non-parallel to the scan direction 335 of the laser elements, e.g. a direction corresponding to the media transport direction 330. In some examples, registration marks are additionally or alternatively indicative of a start and an end of a corresponding calibration portion in a direction that is parallel to the scan direction 335. Registration marks 322, 324, 326 may be used to indicate the beginning and end of each swathe in a plurality of successively written swathes. Accordingly, a given calibration portion may be identified via detection of the corresponding registration marks. The registration marks may be generated by selectively adjusting power outputs of individual laser elements. For example, the output power of a laser element in a location corresponding to a registration mark may be set to 0%, such that the laser element is effectively turned off. In some examples, the registration marks are produced by selectively adjusting the output power of the first and the last laser element in the array of laser elements. In some examples, the output power of the first 3 and the last 3 laser elements in the array may be adjusted to generate the registration marks, such that the first 3 and last 3 lines of each swathe are not written in a location corresponding to a registration mark. Registration marks may be considered to represent a "ruler" that can be used to measure grayscale data within the printed image. In some examples, each registration mark has a length in the scan direction 335 of approximately 2 mm, although other lengths may be also be used.

Different registration marks in the media transport direction 330 may correspond to different facets of a polygon mirror used to scan the laser elements across the surface of the photo imaging plate. In some examples, registration marks are configured to be different for different polygon mirror facets, in order to enable a polygon mirror facet to be identified from other polygon mirror facets using the registration marks. For example, registration marks corresponding to one polygon mirror facet, e.g. a facet that is designated as the 'first' facet, may be different than registration marks corresponding to the other polygon mirror facets, such that the 'first' facet may be identified. A registration mark may be made different from other registration marks by, for example, varying the length and/or width of the registration mark.

Calibration image 300 may be measured, for example by a measurement unit. Measuring the calibration image 300 may comprise measuring an optical property of the calibration portions in the calibration image 300. The measured optical property may include gray values of the image measured by a scanning device, for example. The measurement may include scanning an image and evaluating a gray value at each pixel of the scanned image. For example, where the scan has 8 bits per pixel, each pixel may have a value from 0 to 255, with 0 representing black and 255 representing white. In some examples, the scanning is performed in a 535×600 dots-per-inch mode (vertical×horizontal), although other scanning modes may be used in other examples.

A profile of the measured grayscale data may be produced by averaging the measured pixel values along the scan direction 335 of the laser elements. The average values produce a profile corresponding to one-dimensional data representative of the variation in grayscale values along the medium transport direction 330 within a given calibration portion. In this example, the average is determined before associating parts of the profile with individual laser elements. However, in some examples each of the pixels measured in the calibration portion may be associated with a laser element, and the grayscale values of the pixels associated with each laser element may be averaged to produce a respective averaged grayscale value for each laser element.

In some examples, the measured property is used to evaluate a dot area ratio or a dot area percentage. For example, where a grayscale measurement renders values from 0 to 255, the following calculation may be performed, where gray(measure) is the measured gray value of a pixel of interest (or an average of values measured over a group of pixels of interest), gray(blank) is a measured or predetermined grayscale value of the print medium (e.g. in the absence of printing fluid, toner, etc.), and gray(solid) corresponds to a measured or predetermined value representative of 100% dot area (100% coverage).

Inverse_gray=255−gray(measure)

Inverse_blank=255−gray(blank)

Inverse_solid=255−gray(solid)

Dot area=(Inverse_gray−Inverse_blank)/(Inverse-_solid−Inverse_blank)

Dot area=(gray(blank)−gray(measure))/(gray(blank)−gray(solid))

In some examples, respective profiles may be determined for each of a plurality of successive calibration portions along the media transport direction 330 for a given calibration section, and these profiles may be averaged to produce an averaged profile for the given calibration section. Using an averaged profile may reduce noise and/or sensitivity to local print quality defects. For example, a profile may be generated for each calibration portion by averaging measured values along the scan direction 335, and the resulting profiles of calibration portions that are aligned along the medium transport direction 330 may then be averaged to produce an average profile. Parts of the average profile may then be associated with respective laser elements by dividing the profile by the number of laser elements in the array of laser elements, thus determining a contribution of each of the laser elements to the optical property. Other methods of averaging across calibration portions are also possible. For example, individual pixels in the calibration portions may each be assigned to a respective laser element, and then for each laser element an average may be determined over the pixels assigned to that laser element.

Associating portions of determined profiles with respective laser elements enables the contribution of each of the laser elements to the optical property to be determined. This in turn enables a set of corrections or adjustments to be determined for the laser elements. Each correction in a set of corrections is useable to correct a different laser element in the array of laser elements based on the determined contributions, for example using the format correction function described above. The determined contributions may be translated to laser output power corrections using a predetermined and/or measured factor. After the corrections or adjustments have been determined, the corrections or adjustments may be stored in a data structure. The process may be repeated taking these adjustments into account (i.e. applying these corrections when writing a further calibration image, measuring the further calibration image, obtaining further sets of corrections, etc.). Thus, variations between the laser elements can be reduced in an iterative fashion until a detected variation is below a predetermined threshold, or until a predetermined maximum number of iterations has been reached. In some examples, the variation is evaluated based on a dot area profile derived from the optical property of the printed image.

In some examples, dot area variations between different polygon facets may be reduced or compensated for in a similar manner to that described above. Instead of determining a profile for each calibration portion, the measured gray values across a given calibration portion may be averaged to determine an average gray value for each calibration portion (with different calibration portions in the medium transport direction 330 corresponding to a different polygon facets). The dot area for each polygon facet may then be determined at intervals along the scan direction 335 using the registration marks. Laser corrections may then be determined and applied iteratively as described above, until the dot area variation is below a predetermined threshold, or until a predetermined maximum number of iterations has been reached.

The above process may be performed for each of calibration sections 302, 304, 306. Therefore, sets of corrections may be obtained for different base gray levels corresponding to the different coverages of calibration sections 302, 304, 306. Sets of corrections for different base gray levels may be stored as data structures, for example in memory, to be applied during a print job. Each data structure may relate to a look-up table which enables different gray levels to be mapped to different data structures. Interpolation may be used to obtain corrections for gray levels that are not one of the base gray levels. An interpolation index or identifier may be included in the look-up table that links gray levels to data structures. In some examples, interpolation is not used during the calibration operation itself. This may enable deviations or errors between determined gray levels and actual printed gray levels to be reduced during calibration. Spare or unused fields may be included in the look-up table during a calibration operation to account for interpolation not being used. In some examples, the look-up table is not used during the calibration operation.

In the printed image 300 shown in FIG. 3, position fiducials 340 are provided to facilitate matching a measured image position to the printed image (e.g. when the measurement device is an in-line scanner).

A normalization portion 350 may be provided to facilitate normalization of the gray values. For example, normalization portion 350 may be a solid black region indicative of 100% coverage (e.g. 100% dot area). This area may be measured to determine a value for the gray(solid) parameter described above.

Figure 4:
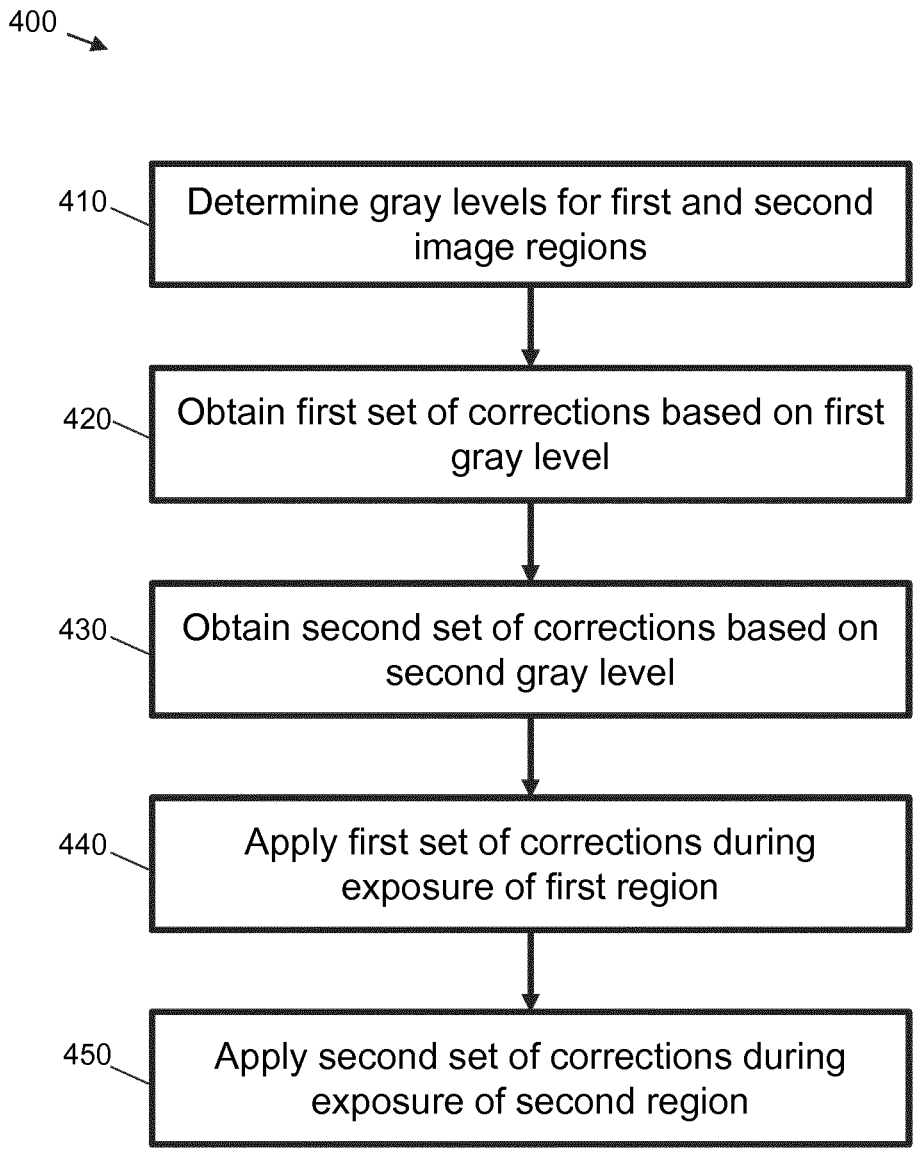
FIG. 4 is a flow chart illustrating a method of generating an exposed image according to an example.

FIG. 4 shows a method 400 of generating an exposed image on a photo imaging plate according to an example. In some examples, the method 400 is performed by an optical controller such as optical controller 140. The optical controller may perform the method based on instructions retrieved from a computer-readable storage medium. The photo imaging plate may comprise photo imaging plate 110.

At item 410, a first gray level for a first region of an image and a second gray level for a second, different region of the image are determined from print input data. In some examples, the first and second gray levels are determined based on digital halftone data for the respective first and second image regions. In some examples, the first and second gray levels are determined based on optical power parameters for the respective first and second image regions. In some examples, the first and second gray levels are received, for example as part of the print input data.

At item 420, a first set of corrections for a plurality of laser elements in an optical exposure unit is obtained, based on the determined first gray level.

At item 430, a second set of corrections for the plurality of laser elements is obtained, based on the determined second gray level.

At item 440, the first set of corrections is applied to the plurality of laser elements during an exposure of the first region on the photo imaging plate.

At item 450, the second set of corrections is applied to the plurality of laser elements during an exposure of the second region on the photo imaging plate.

Therefore, different sets of corrections or adjustments are applied to the plurality of laser elements for different image regions in an exposed image. A set of corrections may comprise a two-dimensional array of corrections, one dimension of which corresponds to a location along a scan direction, and the other dimension of which corresponds to an individual laser element in the plurality of laser elements. In some examples, a set of corrections comprises a third dimension corresponding to an individual facet of a polygon mirror used to scan the laser elements across the surface of a photo imaging plate.

Although in the example shown in FIG. 4 two gray levels are used, in other examples other numbers of gray levels may be used, for example three or seven gray levels.

In one specific implementation, a method of compensating a plurality of optical elements for a given image region begins by determining a gray level for the image region. It is then determined whether an existing data structure from a plurality of data structures corresponds to the determined gray level. Each existing data structure contains compensation factors for the optical elements. Each existing data structure may correspond to a different gray level. If the determined gray level matches a gray level of an existing data structure, the data structure corresponding to the matching gray level is selected for use in compensation for the image region. Compensation factors for the image region are then obtained from the selected data structure. If the determined gray level does not match one of the gray levels which correspond to existing data structures, two data structures are selected for use in compensation for the image region, the two data structures corresponding to the two gray levels that are nearest neighbors to the determined gray level. Interpolation is performed between compensation factors from one of the selected data structures and corresponding compensation factors from the other of the selected data structures to obtain the compensation factors to be applied for the image region. The obtained compensation factors are then applied to the optical elements for the image region.

Figure 5:
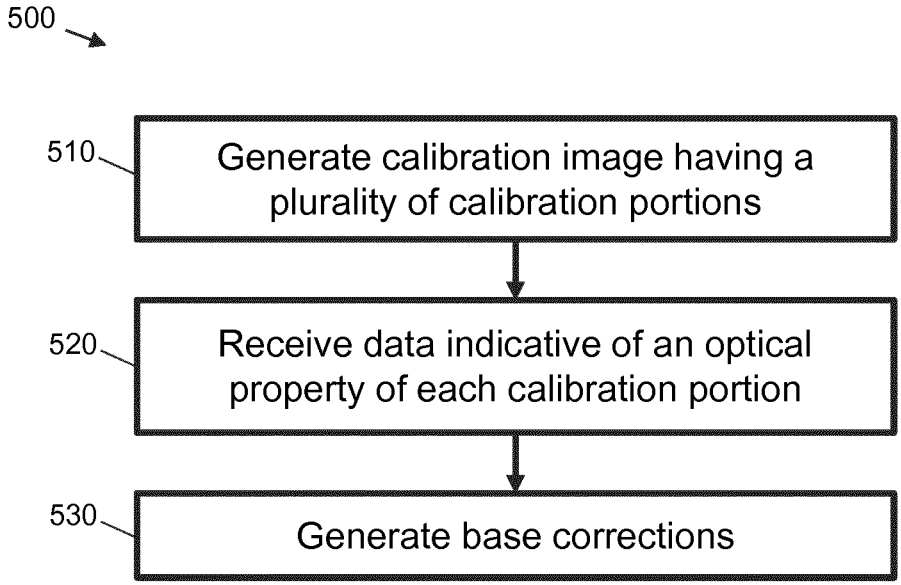
FIG. 5 is a flow chart illustrating a method of calibrating an optical exposure unit according to an example.

FIG. 5 shows a method 500 of calibrating an exposure unit of a printing system according to an example. In some examples, the method 500 is performed by an optical controller such as optical controller 140. The optical controller may perform the method based on instructions retrieved from a computer-readable storage medium. The method 500 may be performed prior to method 400. In some examples, an output of method 500 is used as input for method 400.

At item 510, a printed calibration image is generated, for example by printing system 100. The printed calibration image may be generated by controlling a plurality of laser elements to write a latent image corresponding to the image to be printed onto a photo imaging plate. The calibration image comprises a plurality of calibration portions. Each calibration portion has one of a plurality of different base gray levels. In some examples, each of the calibration portions has corresponding registration marks indicative of a start and an end of the calibration portion in a direction that is non-parallel to a scan direction of the laser elements, e.g. a media transport direction.

At item 520, data indicative of an optical property of each of the calibration portions in the printed calibration image is received. The optical property may be a measured property of an undesired visual artefact such as banding. In some examples, the optical property is a dot area variation in a given calibration portion. The data may be received from a measurement unit. In some examples, a contribution of each of the laser elements to the optical property is determined for each calibration portion. The contribution of each of the laser elements to the optical property for a given calibration portion may be determined by determining a profile of the optical property across the calibration portion in a direction non-parallel to the scan direction. The profile may be determined based on the corresponding registration marks. In some examples, determining the profile of the optical property comprises averaging the optical property in a direction parallel to the scan direction. Portions of the determined profile may then be associated with respective laser elements.

At item 530, sets of base corrections for the plurality of laser elements are generated based on the received data. Each correction in a given set of base corrections may be for correcting a different one of the plurality of laser elements. Each set of base corrections corresponds to a different base gray level. In some examples, the sets of base corrections are stored in memory, for example for use during a print job. In some examples, different sets of base corrections may be generated for different screen angles, to enable the plurality of laser elements to be corrected for different screen angles and different gray levels.

The sets of base corrections may be used in a compensation process such as that described with reference to FIG. 4 above. For example, the first set of corrections and/or the second set of corrections may be obtained using the base sets of corrections. In some examples, the sets of base corrections include the first set of corrections and/or the second set of corrections. Therefore, the first set of corrections and/or the second set of corrections may be selected from the sets of base corrections In some examples, if the determined first gray level and/or the determined second gray level is different from each of the base gray levels, obtaining the first set of corrections and/or the second set of corrections comprises interpolating the sets of base corrections.

In some examples, there may be deviations between the determined gray level value for the image region, derived based on input data, and the actual gray level that is present in the printed image. This may arise, for example, if the size of the image region is smaller than the size of a halftone screen tile. Such deviations may vary depending on the gray level to be printed. Such deviations may affect the applied sets of corrections. In some examples, such deviations do not exceed 1.5% for 220, 270 or 300 LPI (lines per inch) screens. Deviations between the determined gray level value and the actual gray level may be greater for interpolated gray levels (that is, gray levels for which an iterative calibration operation such as that described above with reference to FIG. 3 is not performed, unlike for base gray levels). Therefore, during such an iterative calibration operation, interpolation of gray levels and/or sets of corrections is not used in some examples.

Figure 6:
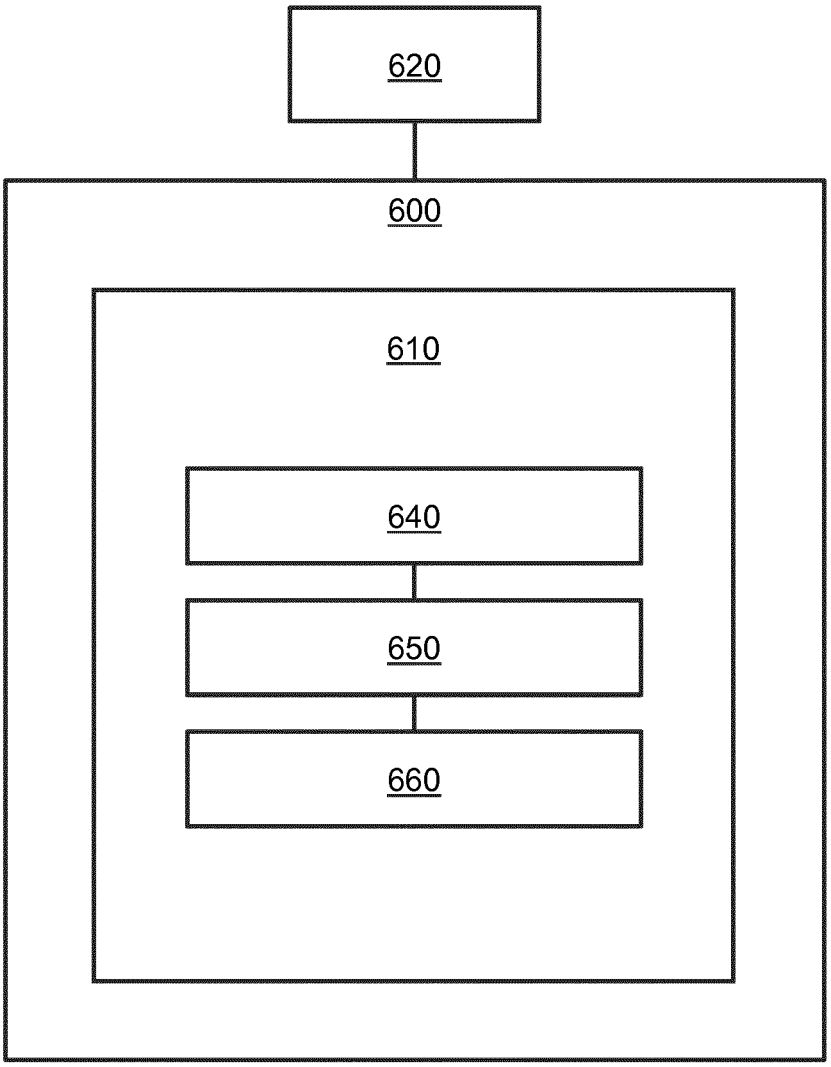
FIG. 6 is a schematic diagram of a processor and a computer readable storage medium with instructions stored thereon according to an example.

FIG. 6 shows a computer-readable storage medium 600, which may be arranged to implement certain examples described herein. The computer-readable storage medium 600 comprises a set of computer-readable instructions 610 stored thereon. The computer-readable instructions 610 may be executed by a processor 620 connectably coupled to the computer-readable storage medium 600. The processor 620 may be a processor of a printing system similar to printing system 100. In some examples, the processor 620 is a processor of an optical controller such as optical controller 140.

Instruction 640 instructs the processor 620 to receive input data. The input data corresponds to a plurality of image regions to be written by a plurality of laser elements onto a photo imaging plate. The input data may comprise digital halftone data. Each of the plurality of image regions has a corresponding gray level that is obtainable using the input data. Instruction 650 instructs the processor 620 to determine, for each image region and based on the corresponding gray level for an image region, a set of adjustment factors. The sets of adjustment factors are for adjusting the output of the plurality of laser elements. In some examples, a given set of adjustment factors is based on a determined contribution of each of the plurality of laser elements to an optical property in a written image. Instruction 660 instructs the processor 620 to control the plurality of laser elements using the determined sets of adjustment factors to write the corresponding image regions onto the photo imaging plate.

Processor 620 can include a microprocessor, microcontroller, processor module or subsystem, programmable integrated circuit, programmable gate array, or another control or computing device. The computer-readable storage medium 600 can be implemented as one or multiple computer-readable storage media. The computer-readable storage medium 600 includes different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. The computer-readable instructions 610 can be stored on one computer-readable storage medium, or alternatively, can be stored on multiple computer-readable storage media. The computer-readable storage medium 600 or media can be located either in the printing system 100 or located at a remote site from which computer-readable instructions can be downloaded over a network for execution by the processor 620.

Certain examples described herein enable multiple sets of corrections to be applied to optical elements of an exposure unit for different regions in an image. For example, a first image region may use a first set of corrections and a second image region may use a second, different set of corrections. Each set of corrections may comprise a two or three dimensional array indicating how each optical element in an array of optical elements should be corrected at various positions in the corresponding image region. By enabling multiple sets of corrections to be applied in a single image, interactions between different optical elements and/or imperfections in individual optical elements that vary between different gray coverages may be compensated for.

Certain examples described herein enable periodic disturbances or banding in printed images to be reduced, thereby improving visual print quality. Determining contributions of each of a plurality of laser elements to an optical property of a printed image and using such contributions to obtain adjustment factors for each of the laser elements enables a reduction in the visible artifacts caused by interactions between the laser elements. Further, by obtaining and applying different adjustment factors for different image regions based on a gray level for each region, banding may be reduced even when interactions between the laser elements are different for different optical power levels.

Certain examples described herein enable base corrections for a set of base gray levels to be calculated based on direct measurements from a printed image. Interpolated corrections for gray levels other than those in the set of base gray levels may then be determined by interpolating the values of the base corrections. By directly measuring dot area profiles and calculating corresponding base corrections for a set of base gray levels and using interpolation to determine interpolated corrections for gray levels other than those in the set of base gray levels, calibration of an exposure unit of a printer may be simplified. By printing and measuring image sections having gray coverages corresponding to the set of base gray levels, an amount of material, e.g. print medium, to be used for calibration may be reduced. Calibration may be performed quickly and efficiently, with a reduced amount of printer downtime. Moreover, by determining base corrections via direct measurement and determining interpolated corrections based on the base corrections, a high level of accuracy of the corrections may be obtained across a wide range of gray levels.

The preceding description has been presented to illustrate and describe examples of the principles described. This description is not intended to be exhaustive or to limit these principles to any precise form disclosed. Many modifications and variations are possible in light of the above teaching.

What is claimed is:

1. An optical controller for an exposure unit of a printer, the optical controller comprising:

memory to:

store a plurality of data structures each comprising adjustment factors useable to adjust a plurality of optical elements of the exposure unit, wherein different data structures correspond to different gray coverages in an image generated by the printer; and a processor to:

determine gray levels for different image regions in input image data;

link the determined gray levels to corresponding data structures within the plurality of data structures to obtain adjustment factors for the different image regions; and adjust the optical elements for each image region using the corresponding obtained adjustment factors to enable the generation of an exposed image using the exposure unit based on the input image data.

2. The optical controller of claim 1, wherein the processor is to determine a gray level for an image region by:

obtaining digital halftone values from the input image data; and averaging the digital halftone values across the image region.

3. The optical controller of claim 1, wherein the gray coverages in the image generated by the printer correspond to a set of base gray levels, and wherein, if a determined gray level for an image region is different from each of the base gray levels, the processor is to interpolate adjustment factors between different data structures to obtain the adjustment factors for the image region.

4. The optical controller of claim 1, wherein the adjustment factors of each of the data structures are based on a determined contribution of each of the plurality of optical elements to an optical property of the gray coverages in the image generated by the printer.

5. The optical controller of claim 1, wherein the optical elements comprise an array of lasers, and wherein the exposure unit comprises a polygon mirror to scan the array of lasers across a surface of a photo imaging plate of the printer to generate an exposed image on the surface of the photo imaging plate.

6. A printer comprising the optical controller of claim 1.

7. A method of generating an exposed image on a photo imaging plate, the method comprising:

determining, from print input data, a first gray level for a first region of an image and a second gray level for a second, different region of the image;

obtaining, based on the determined first gray level, a first set of corrections for a plurality of laser elements in an optical exposure unit;

obtaining, based on the determined second gray level, a second set of corrections for the plurality of laser elements;

applying the first set of corrections to the plurality of laser elements during an exposure of the first region on the photo imaging plate; and applying the second set of corrections to the plurality of laser elements during an exposure of the second region on the photo imaging plate.

8. The method of claim 7, comprising:

controlling the plurality of laser elements to generate a printed calibration image comprising a plurality of calibration portions each having one of a plurality of different base gray levels;

receiving data indicative of an optical property of each of the calibration portions in the printed calibration image; and generating, based on the received data, sets of base corrections for the plurality of laser elements, each set of base corrections corresponding to a different base gray level, wherein the sets of base corrections are useable to obtain the first set of corrections and/or the second set of corrections.

9. The method of claim 8, comprising interpolating the sets of base corrections to obtain the first set of corrections and/or the second set of corrections.

10. The method of claim 8, comprising, for each calibration portion, determining a contribution of each of the laser elements to the optical property, wherein each correction in a set of corrections is to correct a different one of the plurality of laser elements based on the determined contributions.

11. The method of claim 10, wherein each of the calibration portions in the printed calibration image has corresponding registration marks indicative of a start and an end of the calibration portion in a direction that is non-parallel to a scan direction of the laser elements, and wherein the determining the contribution of each of the laser elements to the optical property for a calibration portion comprises:

determining a profile of the optical property across the calibration portion in a direction non-parallel to the scan direction based on the corresponding registration marks; and associating portions of the determined profile with respective laser elements.

12. The method of claim 11, wherein the determining the profile of the optical property comprises averaging the optical property in a direction parallel to the scan direction.

13. The method of claim 7, wherein the first and second gray levels are determined based on digital halftone data for the respective first and second regions.

14. The method of claim 7, wherein the first and second gray levels are determined based on sets of optical power parameters for each of a plurality of pixels in the first and the second region, and wherein the determining the first and the second gray level comprises averaging the optical power parameters across the pixels of the respective first and second regions.

15. A non-transitory computer-readable storage medium comprising a set of computer-readable instructions that, when executed by a processor, cause the processor to:

receive input data corresponding to a plurality of image regions to be written by a plurality of laser elements onto a photo imaging plate, each of the plurality of image regions having a corresponding gray level obtainable using the input data;

determine, for each image region and based on the corresponding gray level for an image region, a set of adjustment factors for adjusting the output of the plurality of laser elements; and control the plurality of laser elements using the determined sets of adjustment factors to write the corresponding image regions onto the photo imaging plate.

* * * * *